US006978905B2

(12) United States Patent
Chen

(10) Patent No.: US 6,978,905 B2
(45) Date of Patent: Dec. 27, 2005

(54) SUPPORTING FRAME WITH A CASING

(76) Inventor: Feng Yao Chen, No. 168, San Kan Road, Lung Chin Tsun, Lung Ching Hsiang, Taichung Hsien (TW)

( * ) Notice: Subject to any disclaimer, the term of this patent is extended or adjusted under 35 U.S.C. 154(b) by 35 days.

(21) Appl. No.: 10/452,503

(22) Filed: Jun. 3, 2003

(65) Prior Publication Data

US 2004/0245199 A1 Dec. 9, 2004

(51) Int. Cl.[7] ..... A47B 43/00
(52) U.S. Cl. ..... 211/189
(58) Field of Search ..... 211/170, 189; 312/120, 123, 327, 328

(56) References Cited

U.S. PATENT DOCUMENTS 26,930 A * 1/1860 Truax ..... 222/390
253,981 A * 2/1882 Conrad ..... 211/126.15
1,318,308 A * 10/1919 Walker ..... 99/344
1,361,562 A * 12/1920 Bekkering ..... 312/119
1,590,060 A * 6/1926 Rieman et al. ..... 312/123
5,064,256 A * 11/1991 Shepherd ..... 312/221
5,330,263 A * 7/1994 Wilkinson ..... 312/328

* cited by examiner

*Primary Examiner*—Sarah Purol

(57) ABSTRACT

A supporting frame with a casing has a frame body and a casing. The frame body has two inclined lower lateral rods at the lower end and two stopping posts at the upper front ends thereof. Two studs serve to fix the casing so that the casing is rotatable to protrude out of the frame body and can be drawn back into the frame body to be placed on the lower supporting rods. An upper side of the two opposite sides of the casing has a respective inclined edge. A rear lower end of each inclined edge has a protrusion. As the casing protrudes out of the frame body. The protrusion will resist against the stopping posts so that the casing will not leave from the frame body.

1 Claim, 5 Drawing Sheets

SUPPORTING FRAME WITH A CASING

FIELD OF THE INVENTION

The present invention relates to supporting frames, and particularly to a supporting frame with a casing, wherein generally, the casing is placed in the frame body and thus it does not occupy a space in the room. When objects will be placed in the casing, the casing can be pulled out by rotating the casing along studs for fixing the casing.

BACKGROUND OF THE INVENTION

In the prior art, there are two methods for fixing a casing to the frame body. In the first design, the casing is fixed to the frame body, and the casing has a door. The user can open the door for placing objects into the casing or taking objects from the casing. In another design, the casing is made as a drawer which can be pulled out from a casing positioned in the frame body for fixing the drawer or pushing into the casing. However, this design still have a complicated structure and thus it is expensive. Moreover, the operation is inconvenient.

SUMMARY OF THE INVENTION

Accordingly, the primary object of the present invention is to provide a supporting frame with a casing, wherein the supporting frame has a frame body and a casing. The frame body has two inclined lower lateral rods at the lower end and two stopping posts at the upper front ends thereof. Two studs serve to fix the casing so that the casing is rotatable to protrude out of the frame body and can be drawn back into the frame body to be placed on the lower supporting rods. An upper side of the two opposite sides of the casing has a respective inclined edge. A rear lower end of each inclined edge has a protrusion. As the casing protrudes out of the frame body. The protrusion will resist against the stopping posts so that the casing will not leave from the frame body.

The various objects and advantages of the present invention will be more readily understood from the following detailed description when read in conjunction with the appended drawing.

DETAILED DESCRIPTION OF THEN INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
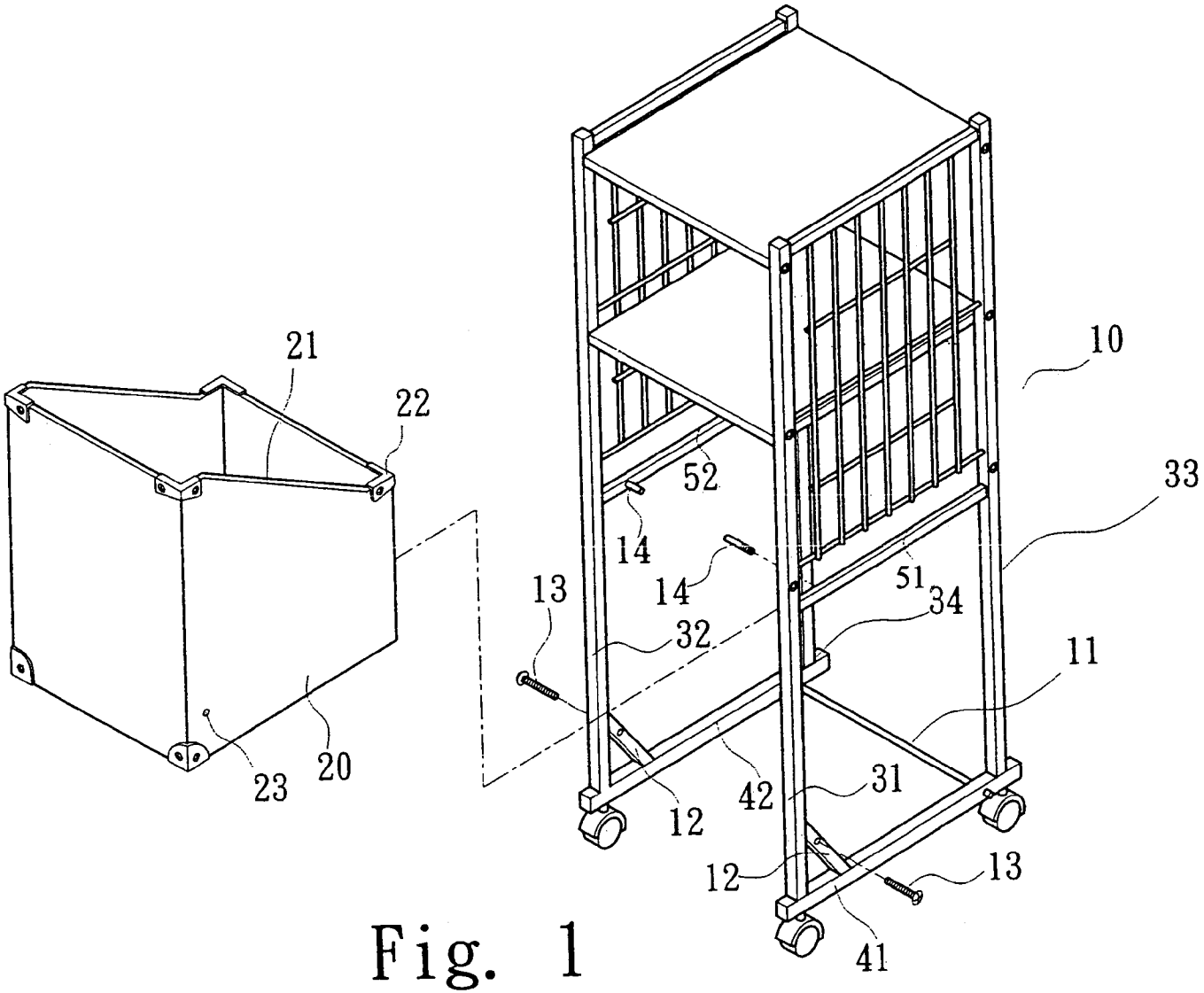
FIG. 1 is an exploded perspective view of the present invention.
Figure 2:
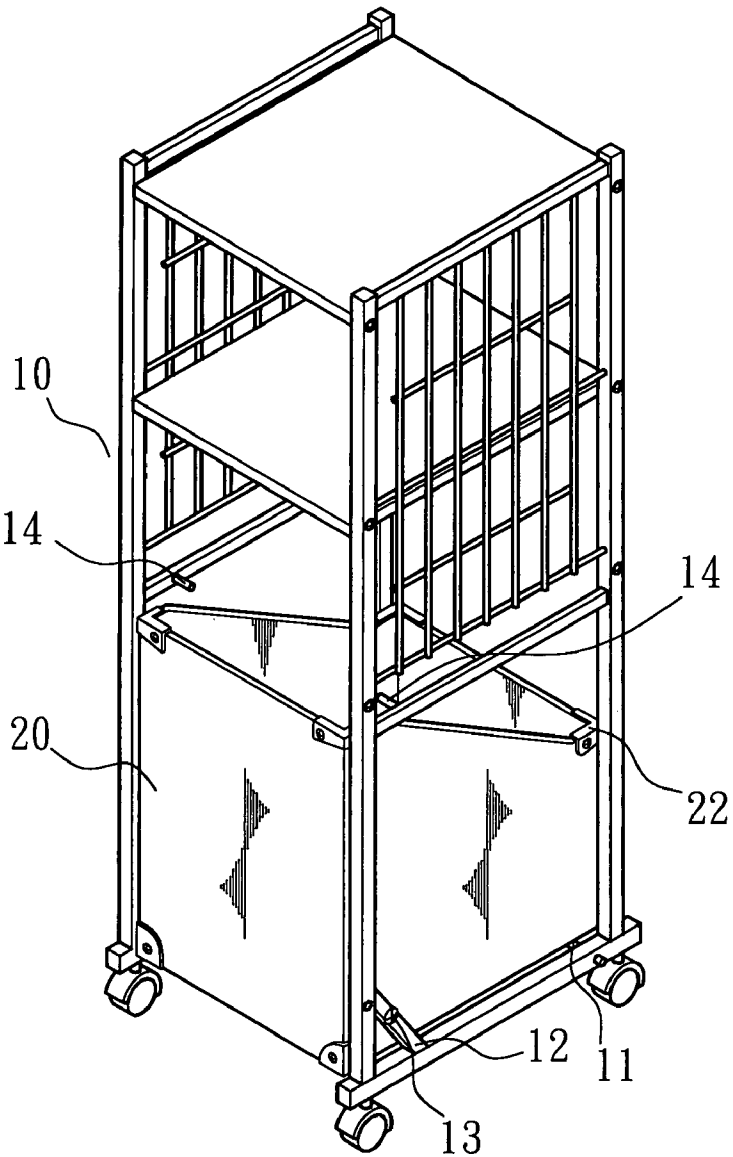
FIG. 2 is a perspective view showing that the casing is drawn back.
Figure 3:
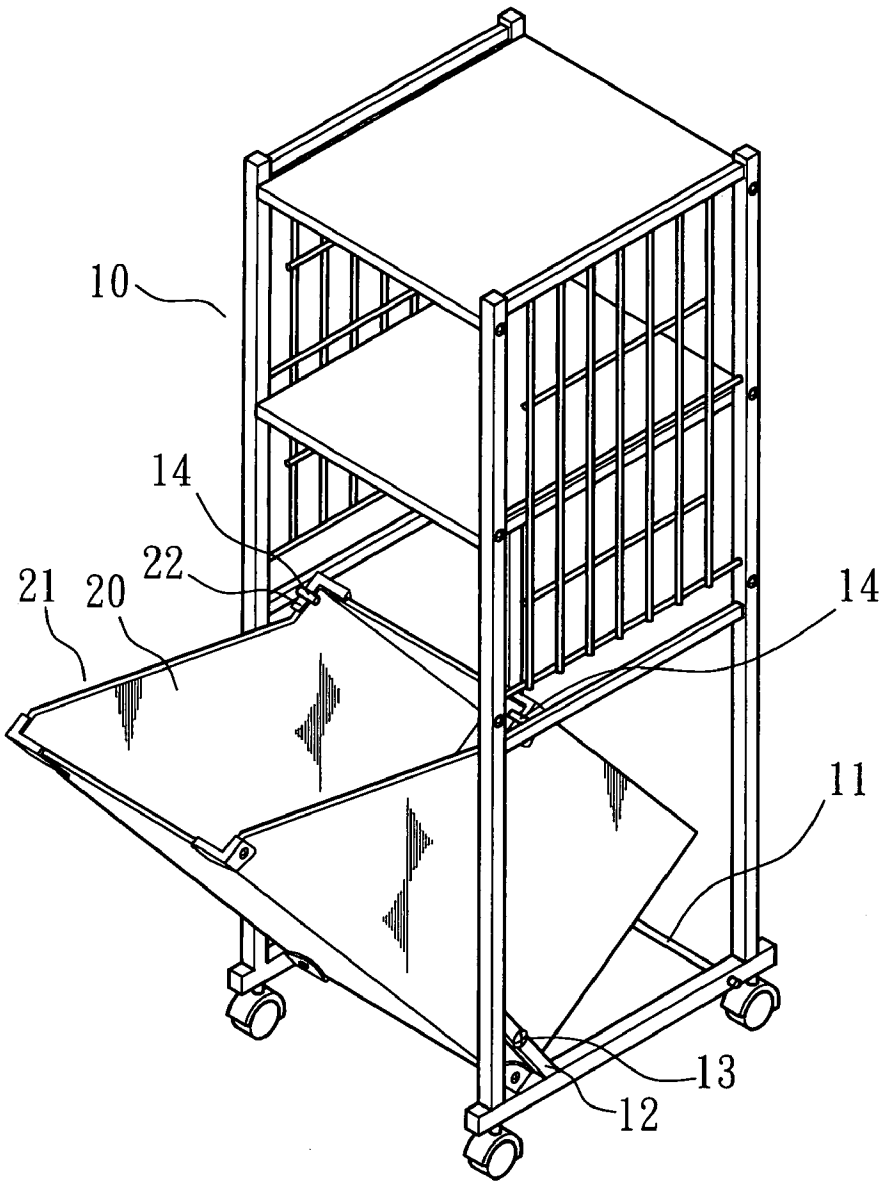
FIG. 3 is a perspective view showing that the casing protrudes out.

Referring to FIGS. 1, 2 and 3, the supporting frame with a casing of the present invention showing a frame body 10 and a casing 20 installed on the frame body 10.

The frame body 10 includes the following elements. A first longitudinal supporting rod 31 and a second longitudinal supporting rod 32 are arranged at a front side of the frame body 10. A third longitudinal supporting rod 33 and a fourth longitudinal supporting rod 34 are arranged at a rear side of the frame body 10. A first lower transversal supporting post 41 is connected between the first longitudinal supporting rod 31 and the third longitudinal supporting rod 33 and a second lower transversal supporting post 42 is connected between the second longitudinal supporting rod 32 and the fourth longitudinal supporting rod 34. The first longitudinal supporting rod 31 is located at the same side of the third longitudinal supporting rod 33; and the second longitudinal supporting rod 32 being located at the same side of the fourth longitudinal supporting rod 34. A first lower lateral rod 12 is connected between the first transversal supporting post 31 and the first lower transversal supporting post 41; and a second lower lateral rod 12' is connected between the second longitudinal supporting rod 32 and the second lower transversal supporting post 42. Each of the first and second lower supporting rods 12, 12' has a stud 13 passing through the first and second lower supporting rod 12, 12'. A first upper transversal supporting post 51 is connected between the first longitudinal supporting rod 31 and the third longitudinal supporting rod 33 and a second lower transversal supporting post 52 is connected between the second longitudinal supporting rod 32 and the fourth longitudinal supporting rod 34. Each of a front end of the first and second upper transversal supporting post 51, 52 having a respective stopping post 14 which is inserted into the respective upper transversal supporting post 51, 52. A lower rear end of the frame body 10 has a lower supporting rod 11.

A front lower area of two opposite sides of the casing 20 has an axial hole 23 at a position with respect to the respective stud 13. The stud 13 can fix the casing 20 to the frame body 10, while the casing 20 is rotatable so as to protrude out of the frame body 10 or is drawn back into the frame body 10 so as to be placed on the lower supporting rods 11. An upper edge of each of the two opposite sides of the casing 20 is an inclined edge 21. A rear lower end of each inclined edge 21 has a protrusion 22. As the casing 20 protrudes out of the frame body 10, the protrusion will buckle the stopping posts 14 so that the casing 20 will not leave from the frame body 10.

Figure 4:
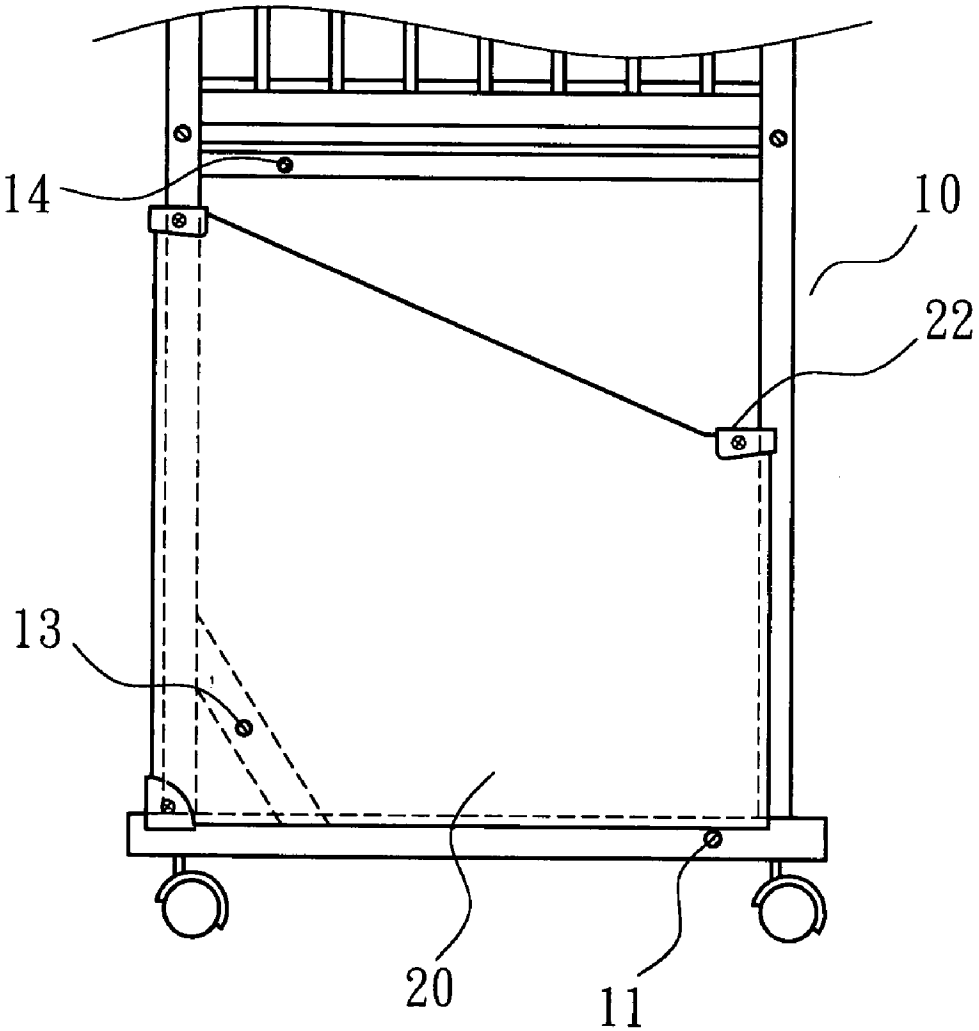
FIG. 4 is a plane perspective view showing that the casing is drawn back into the frame body.
Figure 5:
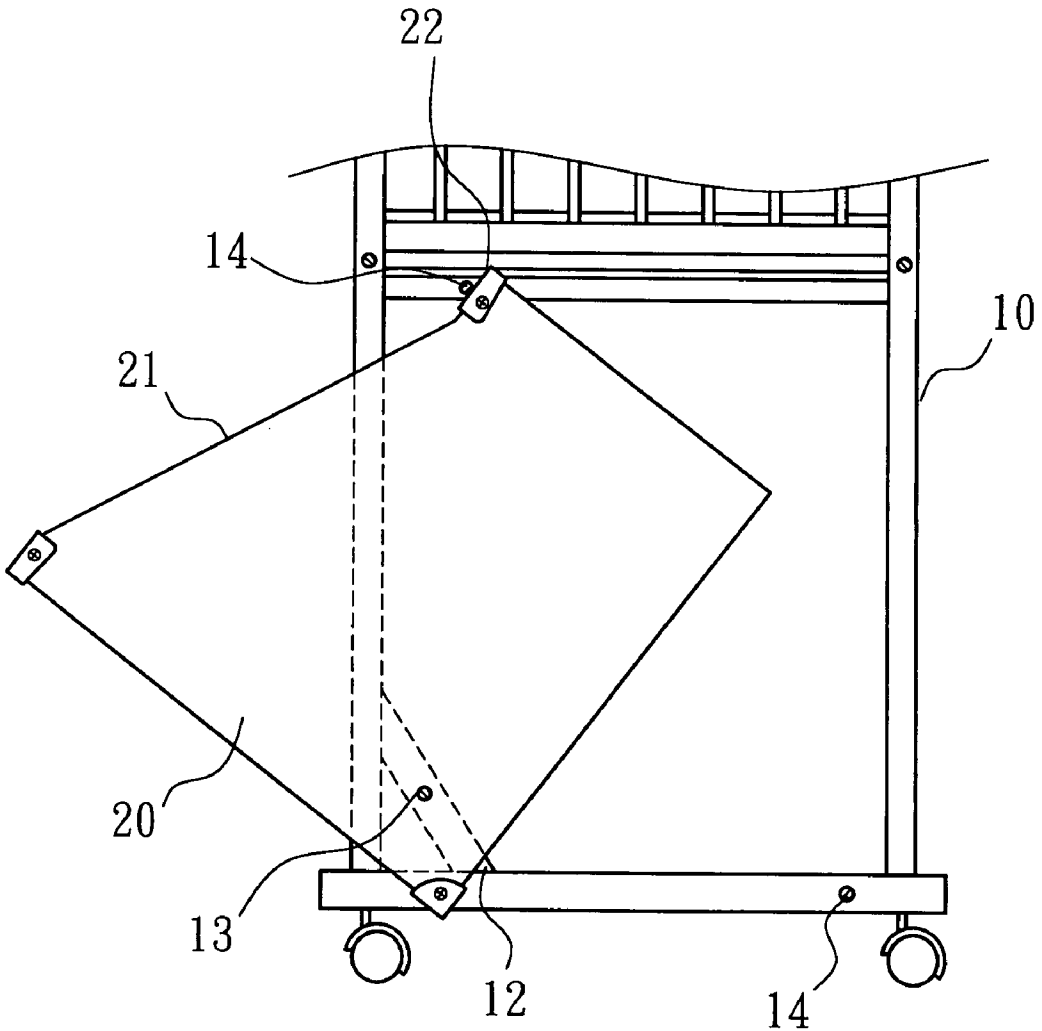
FIG. 5 is a plane schematic view showing that the casing protrudes out.

With reference to FIG. 4, when no object is placed in the casing 20, the casing 20 is placed in the frame body 10 and thus it does not occupy a space in the room. When objects will be placed in the casing 20, the casing 20 can be pulled out by rotating the casing 20 along the studs 13 in the axial holes 23, as shown in FIG. 5. Moreover, the casing 20 will be stopped by the buckles 22 being stopped by the stopping posts 14. If it is desired to place the casing 20 in the frame body 10, it is only necessary to rotate the casing 20 along a reverse direction. By the gravitational force of the casing 20, the casing 20 will return to a steady position.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A supporting frame with a casing comprising:

a frame body including:

a first vertical supporting rod and a second vertical supporting rod, the first and second vertical supporting rods being arranged at a front side of the frame body;

a third vertical supporting rod and a fourth vertical supporting rod; the third and fourth vertical supporting rods being arranged at a rear side of the frame body; the first vertical supporting rod being located at the same side of the third vertical supporting rod; and the second vertical supporting rod being located at the same side of the fourth vertical supporting rod;

a first lower transverse supporting post connected between the first vertical supporting rod and the third vertical supporting rod and a second lower transverse supporting post connected between the second vertical supporting rod and the fourth vertical supporting rod;

a first lower lateral rod connected between the first transverse supporting post and the first lower transverse supporting post; and a second lower lateral rod connected between the second vertical supporting rod and the second lower transverse supporting post;

each of the first and second lower lateral rods having a stud passing through the first and second lower lateral rod;

a first upper transverse supporting post connected between the first vertical supporting rod and the third vertical supporting rod and a second lower transverse supporting post connected between the second vertical supporting rod and the fourth vertical supporting rod;

each of a front end of the first and second upper transverse supporting post having a respective stopping post which is inserted into the respective upper transverse supporting post; and a casing, a front lower area of each of two opposite sides of the casing having an axial hole at a position with respect to the respective stud; the studs fixing the casing to the frame body, the casing being rotatable so as to protrude out of the frame body and can be drawn back into the frame body to be placed on the lower supporting rod; an upper side of the two opposite sides of the casing having a respective inclined edge; a rear lower end of each inclined edge having a protrusion; as the casing protrudes out of the frame body, the protrusion will resist against the stopping posts so that the casing will not leave from the frame body;

wherein when no object is placed in the casing, the casing is placed in the frame body; when objects will be placed in the casing, the casing can be pulled out by rotating the casing along the studs in the axial holes.

* * * * *